US008663394B2

(12) United States Patent
Fauth et al.

(10) Patent No.: US 8,663,394 B2
(45) Date of Patent: Mar. 4, 2014

(54) DISHWASHER INCLUDING ADDITIVE FEEDER USED IN CONJUNCTION WITH SETTING A PRESSURE FOR WASHING DISHES, AND METHOD THEREOF

(75) Inventors: Michael Fauth, Pleinfeld (DE); Georg Hechtl, Dillingen (DE); Michael Rosenbauer, Reimlingen (DE); Herbert Schmidt, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 868 days.

(21) Appl. No.: 12/083,720

(22) PCT Filed: Oct. 5, 2006

(86) PCT No.: PCT/EP2006/067077

§ 371 (c)(1),
(2), (4) Date: Apr. 16, 2008

(87) PCT Pub. No.: WO2007/045560

PCT Pub. Date: Apr. 26, 2007

(65) Prior Publication Data

US 2009/0159099 A1 Jun. 25, 2009

(30) Foreign Application Priority Data

Oct. 19, 2005 (DE) ..... 10 2005 050 183

(51) Int. Cl.
*B08B 3/02* (2006.01)

(52) U.S. Cl.
USPC ..... 134/18; 134/25.2; 134/56 R; 134/57 D; 134/58 D

(58) Field of Classification Search
USPC .... 134/55 R, 57 D, 56 D, 58 D, 198, 18, 25.2
See application file for complete search history.

(56) References Cited

U.S. PATENT DOCUMENTS

| | | | | |
|---|---|---|---|---|
| 2003/0079760 | A1 * | 5/2003 | Spanyer et al. | 134/18 |
| 2003/0140947 | A1 * | 7/2003 | Han et al. | 134/18 |
| 2003/0196278 | A1 * | 10/2003 | Durfee | 8/158 |
| 2004/0079400 | A1 * | 4/2004 | Young | 134/57 D |
| 2004/0226586 | A1 * | 11/2004 | Ertle et al. | 134/57 D |
| 2005/0133064 | A1 | 6/2005 | Rosenbauer | |

FOREIGN PATENT DOCUMENTS

| | | |
|---|---|---|
| DE | 40 14 776 | 11/1991 |
| DE | 199 51 839 | 5/2001 |
| EP | 0 943 282 | 9/1999 |
| EP | 1 195 128 | 4/2002 |
| EP | 1 362 547 | 11/2003 |
| EP | 1 543 764 | 6/2005 |

OTHER PUBLICATIONS

International Search Report PCT/EP2006/067077.

* cited by examiner

*Primary Examiner* — Saeed T Chaudhry
(74) *Attorney, Agent, or Firm* — James E. Howard; Andre Pallapies

(57) ABSTRACT

A dishwasher, in particular a domestic dishwasher, having a dishwashing compartment and apparatuses for washing tableware using washing liquor, wherein it is possible to set the pressure in the apparatuses for washing tableware. A feed apparatus for an additive is provided, and the pressure in the apparatuses for washing tableware can be set as a function of the metering of the additive in the feed apparatus.

12 Claims, 2 Drawing Sheets

DISHWASHER INCLUDING ADDITIVE FEEDER USED IN CONJUNCTION WITH SETTING A PRESSURE FOR WASHING DISHES, AND METHOD THEREOF

BACKGROUND OF THE INVENTION

The invention relates to a dishwasher, especially a domestic dishwasher with a washing compartment and apparatuses for washing tableware using washing liquor, wherein it is possible to set the pressure in the apparatuses for washing tableware. The invention further relates to a method for operating a dishwasher in which, in a washing program section in which washing liquor is applied to the tableware, the pressure in the apparatuses for washing tableware is varied.

Such a dishwasher is known for example from US 2004/0079400 A1. This discloses a dishwasher in which the operating state of a pump is controlled as a reaction to the turbidity of the washing liquor determined by a sensor. In this case the volume and/or the pressure of the washing liquor which is applied to the tableware to be washed are varied as a function of the turbidity of the washing liquor. The pump is configured in such cases to assume a plurality of operating states, with which different flow rates of the washing liquor can be set at the pump output.

A rerouting device for influencing the directional characteristic of the hydraulic arrangement and the circulating pump in order to allow a greater variation in the application of the washing liquor to the tableware is described in DE 101 63 184 A1. The characteristic of the hydraulic arrangement is changed by varying the flow of washing liquor through the rerouting device and the directional characteristic of the circulating pump by controlling the speed of the circulating pump.

A dishwasher in which the tableware held in the dishwasher is especially able to be cleaned as a function of the sensitivity and/or of the type and/or the intensity of the soiling, is described in DE 198 12 231 A1. In this device the speed of a motor of a circulating pump is able to be set. By setting the speed the pressure of the washing liquor can be varied over a wide range. In this case a delicate items program is provided in which the pump motor runs at a lower speed, and which can be selected when delicate items of tableware are held in the dishwasher. By contrast an intensive program is provided in which the pump motor runs at a high speed and which can be selected when heavily-soiled items of tableware are to be cleaned. Optionally the pressure can be controlled by means of valves in the supply pipes to the upper and lower basket.

Finally a domestic washing appliance is known from DE 199 51 839 A1 in which the speed of the circulating pump is influenced by a control device. In this case a turbidity sensor arranged in the domestic appliance monitors the cleaning liquid and issues a sensor signal to the control device. The speed of the circulating pump is set on the basis of this sensor signal. The pump speed is regulated in order to set a necessary volume of liquid in the pump sump, so that no air is sucked in through the pump.

The common aim underlying the prior art dishwashers described was to provide dishwashers with the lowest possible water consumption. This is brought about by setting the pressure in the apparatuses for washing the tableware, with the turbidity of the circulated washing liquor being included as a parameter for setting the pressure.

BRIEF SUMMARY OF THE INVENTION

An object of the present invention is to specify a dishwasher and a method for operating a dishwasher in which the use of resources is further optimized.

To achieve this object a generic dishwasher is proposed in which a feed device for an additive is provided and the pressure in the apparatuses for washing dishes is able to be set as a function of the metering of the additive in the feed device.

This makes it possible to take into account the effect of the additive on the behavior of the washing liquor. Thus for example a formation of foam caused by the additive means in the washing liquor can be taken into account, which can for example lead to air being sucked in through a circulating pump of the dishwasher. A consequence of the sucking-in of air through the circulating pump is however that the user is aware of an increase in the noise emitted. These types of operating state can be avoided with the inventive dishwasher.

In accordance with a preferred embodiment the dishwasher features a first sensor device for checking whether the feed device is provided with the additive. If no additive is detected in the feed device, then no additive can be fed into the washing liquor during a subprogram step. The presence of an additive in the feed apparatus thus forms a criterion or a parameter for influencing the pressure in the apparatuses for washing tableware.

In accordance with a further embodiment the dishwasher can feature a selection device which enables a setting to be made as to whether and/or with what intensity the additive is to be metered. While the first variant allows automatic detection of the presence of additive in the feed apparatus, the selection apparatus allows a presetting to be undertaken as to whether—regardless of the presence of additive in the feed apparatus—additive is to be metered and if necessary the quantity in which it is to be added.

In accordance with a further embodiment of the invention the additive of which the presence is to be detected is a rinse aid and the feed apparatus device is a metering device for the rinse aid. The presence of rinse aid can for example be included for the decision as to whether a conventional washing program or a so-called 3-in-1 washing program is executed. The absence of rinse aid in the feed apparatus can be used as an indication of whether the user is using a combined active agent preparation for reasons of convenience, which for example contains the components cleaner, softener and rinse aid substance. Such a washing program tailored to a combination preparation however needs a larger amount of energy to achieve a satisfactory washing result, which results from the higher temperature in a "rinsing" subprogram step in order to achieve a good drying result. This increased energy demand can be countered by the invention in that the pressure is set appropriately, especially reduced, in the absence of an additive, in the apparatuses for washing tableware. This means that a smaller amount of fresh water is to be supplied, so that the energy required for heating up the fresh water is reduced in at least the program steps "prewashing", "cleaning" and the disadvantage of the increased energy demand is compensated for in the subprogram step "rinsing".

In accordance with a further preferred embodiment a second sensor device, determining the degree of turbidity in the washing liquor is provided, with the degree or turbidity able to be included as a further parameter for setting the pressure in the apparatuses for washing the tableware This enables the pressure to be set as a function of the degree of soiling of the tableware to be washed.

In accordance with a further embodiment there is provision for the pressure in the apparatuses for washing to be low if no additive is mixed into the washing liquor and if the degree of turbidity determined by the second sensor device does not exceed a specific threshold value. The pressure is preferably reduced in at least one of the subprogram steps "prewashing" or "cleaning", with the setting or reduction of the pressure also being able to be provided in the other subprogram steps in which washing liquor is applied to the tableware. By reducing the pressure as a function of the parameters of the presence of the additive and of the degree of soiling of the tableware, an energy-optimized operation of the dishwashing machine can be achieved. In addition, if the above-mentioned criteria obtain, the reduction in pressure allows the dishwasher to be operated with reduced noise emissions.

In accordance with a further embodiment the apparatuses for washing the tableware feature a first crockery basket, a spray device assigned to the first crockery basket as well as a first feed line connecting the first spray device to a circulating pump and at least one second crockery basket, a second spray device assigned to the at least one second crockery basket as well as a second feed line connecting the at least one second spray device with a circulating pump, with the pressure being able to be set low in the first or the at least one second feed line or in both feed lines.

The setting of the pressure in the apparatus for washing tableware can on the one hand be undertaken by variation of the pump speed of a motor of a circulating pump or by a rerouting device influencing the flow cross section in the feed lines.

In the inventive method for operating a dishwasher, in which washing liquid is applied to tableware in a washing program step, the pressure in the apparatuses for washing dishes is set as a function of the metering of an additive, especially of a rinse aid.

Preferably the setting of the pressure in the apparatuses for washing dishes is also made dependent on a measured degree of turbidity of the washing liquor, with the full pump pressure in the apparatuses for washing tableware being reduced if a high amount of soiling has been detected by the turbidity sensor.

Accordingly the pressure in the apparatuses for washing tableware is set to low if no additive is metered into the washing liquor and the degree of turbidity does not exceed a specific threshold value.

For further optimization there can be provision for the pressure optionally to be set to low in one of the two apparatuses for washing tableware in an upper basket or in a lower basket.

The setting of the pressure of the washing liquor applied to the tableware as a function especially of the absence, of the metering of an additive, especially of a rinse aid, enables on the one hand an energy-optimized operation and on the other hand a reduction in the noise generated during operation of the dishwasher.

DETAILED DESCRIPTION OF THE PRESENT INVENTION

Figure 1:
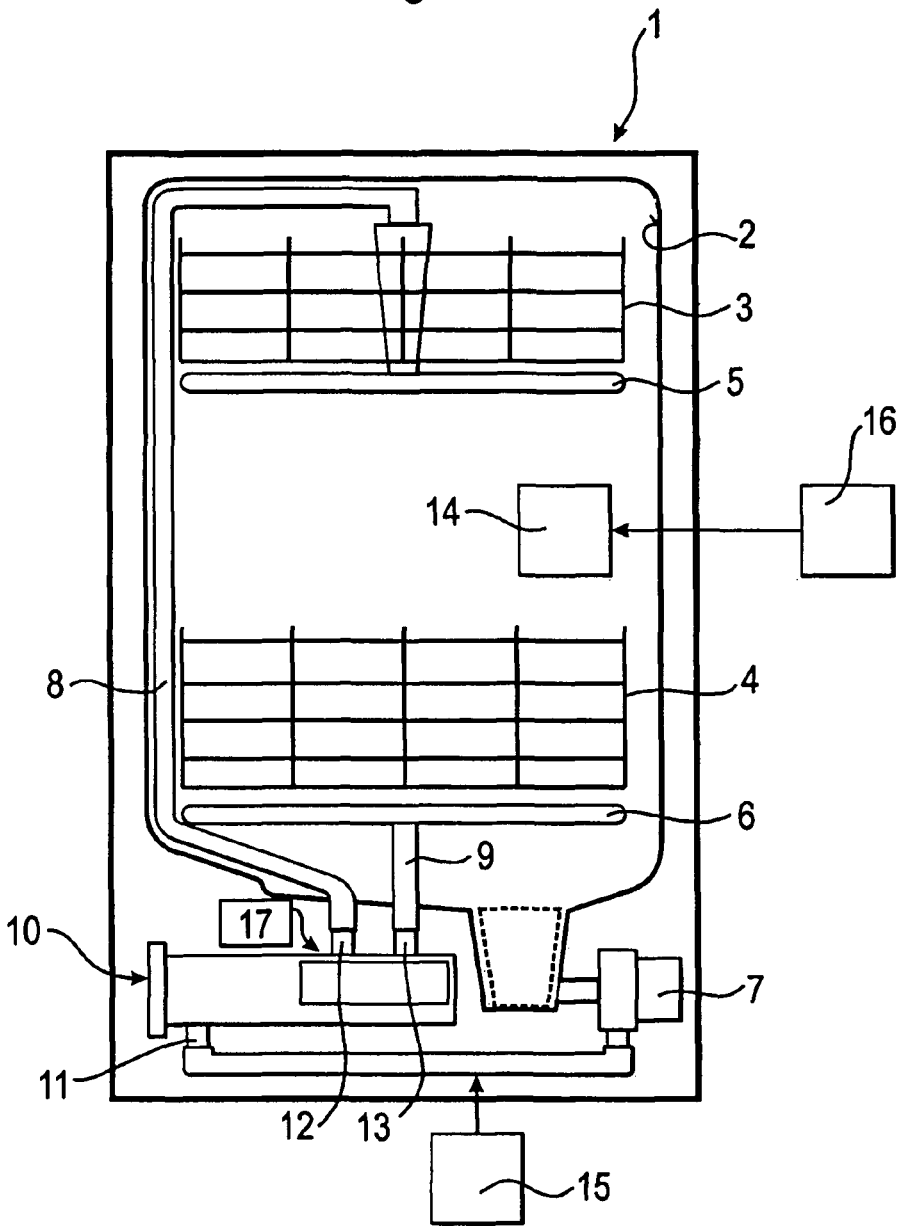
FIG. 1 is schematic of a dishwasher in accordance with an exemplary embodiment of the present invention.

The domestic dishwasher 1 shown in FIG. 1 features a washing compartment, which is usually filled with items not shown in the figure, e.g. soiled tableware and cutlery, usually in crockery baskets 3, 4 of a washing compartment 2. Two spray devices 5, 6 are arranged in the dishwasher I which apply washing liquor to the tableware to be washed arranged in the crockery baskets 3, 4. This liquid, which is usually called washing liquor, is transported by means of a circulating pump 7 in feed lines 8, 9 to the spray devices 5, 6. Usually the washing liquor transported in dishwashers 1 is heated up in at least one subprogram step of a washing program, to which end the dishwasher 1 in the exemplary embodiments shown has a flow-through water heater 10. The washing liquor transported in the dishwasher 1 is routed by the circulating pump 7 to an inlet sleeve 11 of the flow-through water heater 10 and through the latter. The flow-through water heater features two outlet sleeves 12, 13. From the outlet sleeves 12, 13 of the flow-through water heater 10 the washing liquor is directed via the feed lines 8, 9 to the respective different spray devices 5, 6. The heating elements necessary for heating up the washing liquor in the flow-through water heater 10 are not shown in the figure.

A line connecting the circulating pump with the flow-through water heater 10 is also assigned a turbidity sensor 15. The turbidity sensor 15 detects the degree of turbidity of the washing liquor transported by the circulating pump 7 through the line.

Also shown schematically is a feed apparatus 14 for a rinse aid. The feed apparatus 14 is assigned a sensor device 16 which is embodied to detect whether or not rinse aid is in the feed apparatus 14.

Figure 2:
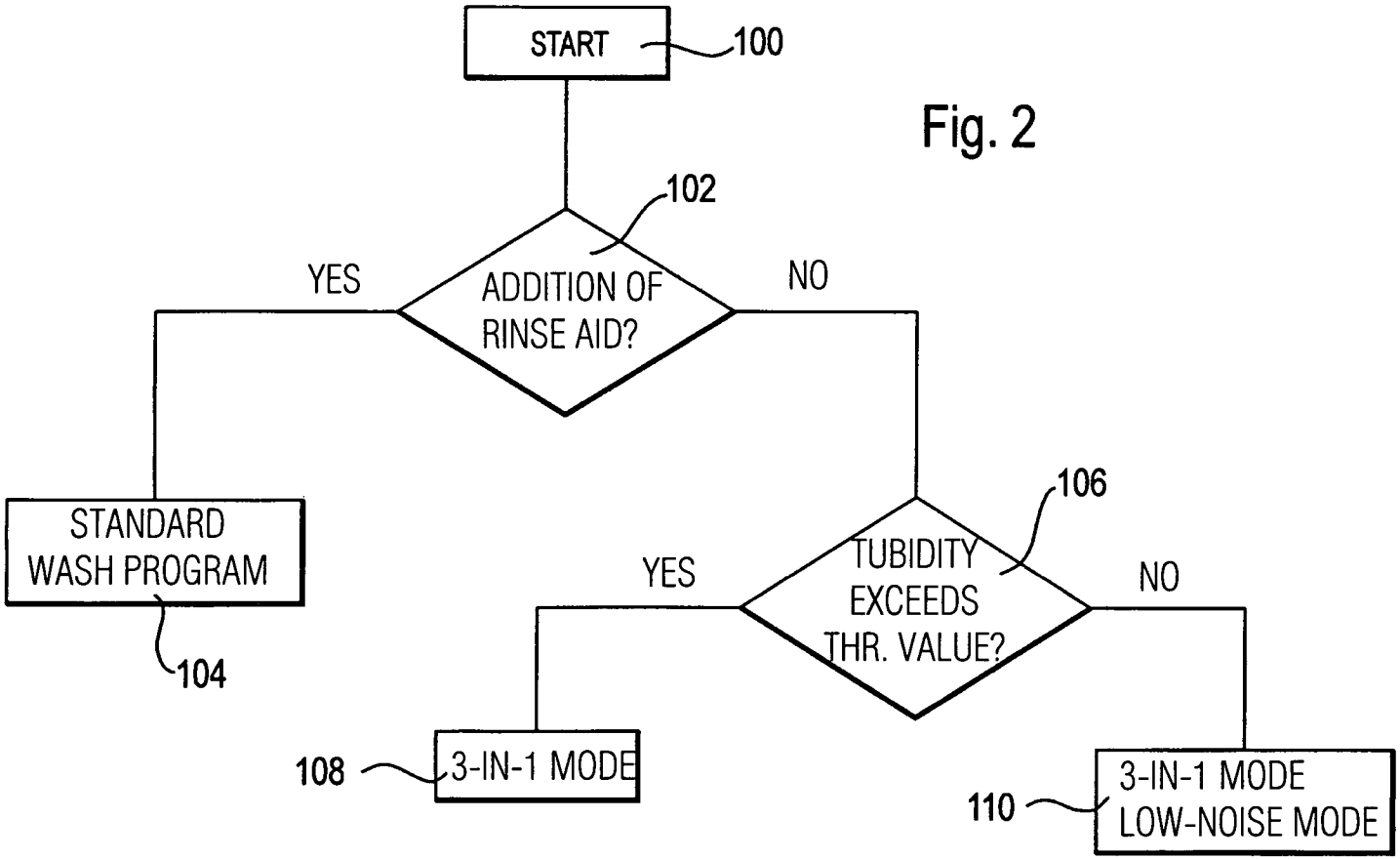
FIG. 2 is a flowchart of an operation of a dishwasher in accordance with an exemplary embodiment of the present invention.

In an alternate embodiment there can be provision for the feed apparatus 14 to be provided with a selection facility with which the user of the dishwasher 1 can define whether and if necessary what quantity of rinse aid to add to the washing liquor during a washing program. The operating method of the dishwasher 1 from FIG. 1 is described below with reference to FIG. 2. After a washing has been started by a user (step 100) a check is made in step 102 as to whether a rinse aid is to be added during the subsequent course of the washing program. If this is the case, a standard washing program 104 is run. If no rinse aid is to be added, which can be determined either through the detection of the absence of rinse aid in the feed apparatus or through a corresponding preselection by the user, a washing program for 3-in-1 combination preparation is started, which is adapted to the specific characteristics of this combination preparation. In this type of washing program known per se, an attempt is made in particular to take away rinsed-off substance which has usually already been released during a "cleaning" subprogram step, up to a "rinsing" subprogram step. Since the adaptation of corresponding washing programs from the prior art has been sufficiently described, a more detailed description will be omitted at this point.

The inventive method of operation takes a measurement during a further subprogram step, e.g. rinsing or cleaning, of the degree of turbidity of the washing liquor being moved by the circulating pump. If the turbidity does not exceed a predetermined threshold value (step 106), during at least one subprogram step the pressure with which the liquor is applied to the tableware to be cleaned is reduced. This modified 3-in-1 washing program is identified in FIG. 2 in step 110 as 3-in-1 mode/low-noise mode, since a reduced noise emission is associated with a reduction of the pressure. Thus in the cases in which only a small amount of soiling is introduced into the dishwasher and the full pump pressure is not necessary the pump pressure is reduced. This also guarantees that the tableware is cleaned reliably, with on the one hand a reduction in the noise generated and on the other hand a smaller volume of fresh water needing to be supplied, e.g. in a "cleaning" subprogram step. This enables the increased energy consumption in a conventional 3-in-1 dishwashing program, as will be executed in accordance with step 108 if the turbidity has exceeded a specific threshold value, to be compensated for. This is the result of, in a "drying" subprogram" step, a higher temperature for drying having to be provided for drying the rinse agent on the tableware by comparison with a conventional dishwashing program in accordance with step 104, which is set by defining the temperature of the rinsing liquid in the subprogram step "rinsing". The energy reduction in a modified 3-in-1 mode compared to a conventional 3-in-1 dishwashing program results from that fact that, because of the lower pressure, at least in the "cleaning", subprogram step, a smaller volume of fresh water needs to be supplied, which means that heating up to the required rinse temperatures is associated with a lower energy expenditure.

The regulation of the pressure as a function of the parameters "presence of rinse aid" and "degree of turbidity of the rinsing water" can be effected by controlling the speed of a motor of the circulating pump and/or by changing the flow cross section in the feed lines. To do this a rerouting device 17 assigned to the output flanges 12, 13 can be used for example, as is described in DE 101 63 184 A1.

The invention provides a dishwasher with which, in a simple and cost-effective way, using the sensor device already present in conventional dishwashers, energy savings and noise reduction are possible in a dishwashing program adapted for combination preparations.

The invention claimed is:

1. A dishwasher, comprising:

an additive feeder;

an additive sensor to indicate whether or not there is an additive in the additive feeder;

a spray device to spray washing liquid onto dishes in the dishwasher; and a pressure setting arrangement to set a first pressure of the washing liquid if the additive sensor indicates that the additive is in the additive feeder and to set a second pressure of the washing liquid if the additive sensor indicates that the additive is not in the additive feeder.

2. The dishwasher of claim 1, wherein the second pressure is lower than the first pressure.

3. The dishwasher of claim 1, further comprising:

a turbidity sensor to detect a turbidity level of the washing liquid; and a comparator to compare the turbidity level of the washing liquid to a turbidity threshold value and to output a comparison result;

wherein the pressure setting arrangement is configured to set a third pressure of the washing liquid if the additive sensor indicates that the additive is not in the additive feeder and if the comparison result of the comparator indicates that the turbidity level of the washing liquid exceeds the turbidity threshold value;

wherein the pressure setting arrangement is configured to set a fourth pressure of the washing liquid if the additive sensor indicates that the additive is not in the additive feeder and if the comparison result of the comparator indicates that the turbidity level of the washing liquid does not exceed the turbidity threshold value; and wherein the fourth pressure of the washing liquid is lower than the third pressure of the washing liquid.

4. The dishwasher of claim 1, further comprising:

a circulation pump having a motor, the circulation pump to circulate the washing liquid in the dishwasher; and a feed line having a flow cross section, the feed line connecting the circulation pump to the spray device;

wherein the pressure setting arrangement is configured to at least one of control a speed of the motor of the circulation pump and change the flow cross section of the feed line in order to set at least one of the first and second pressure of the washing liquid.

5. The dishwasher of claim 1, further comprising a metering intensity selector to select an intensity with which the additive is fed from the additive feeder into the dishwasher.

6. The dishwasher of claim 1, wherein the additive is rinse aid, and wherein the additive feeder is a rinse aid feeder.

7. A method of operating a dishwasher, the method comprising:

detecting whether or not there is an additive in an additive feeder of the dishwasher;

setting a first pressure of washing liquid that is sprayed onto dishes in the dishwasher if the additive is detected in the additive feeder; and setting a second pressure of the washing liquid if the additive is not detected in the additive feeder.

8. The method of claim 7, wherein the second pressure is lower than the first pressure.

9. The method of claim 7, further comprising:

detecting a turbidity level of the washing liquid;

comparing the turbidity level of the washing liquid to a turbidity threshold value and outputting a comparison result;

setting a third pressure of the washing liquid if the additive is in the additive feeder and if the comparison result indicates that the turbidity level of the washing liquid exceeds the turbidity threshold value; and setting a fourth pressure of the washing liquid if the additive is not in the additive feeder and if the comparison result indicates that the turbidity level of the washing liquid does not exceed the turbidity threshold value;

wherein the fourth pressure of the washing liquid is lower than the third pressure of the washing liquid.

10. The method of claim 7, wherein at least one of the first and second pressure of the washing liquid is set by at least one of controlling a speed of a motor of a circulation pump and changing a flow cross section of a feed line that connects the circulation pump to a spray device that sprays the washing liquid onto the dishes.

11. The method of claim 7, further comprising selecting a metering intensity with which the additive is fed from the additive feeder into the dishwasher.

12. The method of claim 7, wherein the additive is rinse aid, and wherein the additive feeder is a rinse aid feeder.

* * * * *

UNITED STATES PATENT AND TRADEMARK OFFICE

CERTIFICATE OF CORRECTION

PATENT NO. : 8,663,394 B2
APPLICATION NO. : 12/083720
DATED : March 4, 2014
INVENTOR(S) : Fauth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 545 days.

Signed and Sealed this
Twenty-ninth Day of September, 2015

Michelle K. Lee

Michelle K. Lee
*Director of the United States Patent and Trademark Office*